US008555793B2

(12) United States Patent
Maniaci

(10) Patent No.: US 8,555,793 B2
(45) Date of Patent: Oct. 15, 2013

(54) ACTIVE HARDPLATE

(75) Inventor: Anthony Charles Maniaci, Temecula, CA (US)

(73) Assignee: American Security Products Co., Fontana, CA (US)

( * ) Notice: Subject to any disclaimer, the term of this patent is extended or adjusted under 35 U.S.C. 154(b) by 0 days.

(21) Appl. No.: 13/134,042

(22) Filed: May 26, 2011

(65) Prior Publication Data

US 2012/0298019 A1 Nov. 29, 2012

(51) Int. Cl.
*E05G 1/04* (2006.01)

(52) U.S. Cl.
USPC ..... 109/59 T; 109/59 R; 70/1.5; 70/416; 70/417

(58) Field of Classification Search
USPC ..... 109/59 R, 59 T; 70/1.5, 416, 417, 70/DIG. 43
See application file for complete search history.

(56) References Cited

U.S. PATENT DOCUMENTS

| | | | | |
|---|---|---|---|---|
| 119,258 | A | 9/1871 | Yale | |
| 218,704 | A | 8/1879 | Bruner | |
| 1,384,509 | A | 7/1921 | Blecksmith | |
| 1,448,525 | A | 3/1923 | Dillon | |
| 1,550,953 | A | 8/1925 | Dillon | |
| 2,690,144 | A | 9/1954 | Ellis et al. | |
| 2,947,160 | A | 8/1960 | Wolters | |
| 3,083,563 | A * | 4/1963 | Greenwald | 70/417 |
| 3,204,438 | A | 9/1965 | Sollenberger | |
| 3,741,597 | A | 6/1973 | Ohno | |
| 4,147,044 | A * | 4/1979 | Bernath | 70/119 |
| 4,470,275 | A | 9/1984 | Fisher | |
| 4,509,350 | A | 4/1985 | Gartner | |
| 4,628,715 | A | 12/1986 | Uyeda et al. | |
| 4,648,255 | A | 3/1987 | Gartner | |
| 4,754,629 | A * | 7/1988 | Allen | 70/333 R |
| 4,961,328 | A * | 10/1990 | Mundhenke | 70/1.5 |
| 5,297,404 | A * | 3/1994 | Embry | 70/1.5 |
| 5,305,695 | A * | 4/1994 | Lichter | 109/59 R |
| 5,906,125 | A * | 5/1999 | Shen | 70/370 |
| 6,240,754 | B1 * | 6/2001 | Petersen | 70/417 |
| 6,434,986 | B1 | 8/2002 | Rice et al. | |
| 6,679,087 | B2 | 1/2004 | Suggs et al. | |
| 7,665,405 | B2 | 2/2010 | Evans et al. | |
| 8,079,512 | B1 * | 12/2011 | Fitler et al. | 235/379 |
| 8,250,887 | B2 * | 8/2012 | MacKay et al. | 70/1.5 |
| 2010/0050535 | A1 * | 3/2010 | Brimont | 49/503 |

* cited by examiner

*Primary Examiner* — Suzanne Barrett
(74) *Attorney, Agent, or Firm* — F. Eugene Logan

(57) ABSTRACT

A safe or other secure containment having a body, a door for entry into the body, a moveable latch system effective for latching and unlatching the door to the body, a lock attached to the door for locking the safe is made more secure by an active hardplate and an independent lockout means effective for preventing the unlatching of the safe door upon the displacement of the active hardplate caused by an unauthorized and unlawful attempted entry into the safe. Existing safes also can be modified.

14 Claims, 5 Drawing Sheets

ACTIVE HARDPLATE

BACKGROUND OF THE INVENTION

This invention relates to safes and other secured containments with a body surrounded by a wall with an entry door into the body. The entry door has a latching mechanism for latching and unlatching the door to the body and a lock for locking the door to the body. The entry door when closed and latched to the body forms and defines an internal safe cavity.

Latching bolt systems that have a single bolt latch and multiple bolt latches are known. For example, U.S. Pat. Nos. 6,679,087 and 7,665,405 disclose latch systems that are latched on just one side of a safe door to the safe body, while other systems latch multiple sides including top and bottom of the safe door.

Anti-drill plates and materials are also disclosed for use in locks and safes. For example, U.S. Pat. No. 6,679,087 also discloses an anti-drill plate secured to the inside surface of safe door that must be drilled through before the lock is reached and before a relocker system is engaged.

U.S. Pat. No. 6,434,986 discloses a lock with a hard plate with an outwardly facing convex surface that tilts on its mounting bracket when contacted by a drill bit.

U.S. Pat. No. 4,648,255 discloses a safe with two hardened-material plates with hardened steel ball bearings therebetween and a second locking mechanism for relocking the safe upon a drill attack. A drill attack on the combination dial or door must first drill through a first plate, then through one or more ball bearings, then through a second plate, then into a cylindrical opening in the second locking system to fracture breakaway screws that held a release plate against the lock works.

U.S. Pat. No. 4,509,350 discloses a combination dial mounted on a safe door with a protective mounting platelike body of a hardened material welded to the inside surface of a safe door in front of a lock works.

U.S. Pat. No. 4,470,275 discloses a protective lock mounting plate for safe door locks having a drill-resistant disc rotatably mounted between the lock and the door. A drill attack on the lock rotates the disc making the drilling more difficult.

U.S. Pat. No. 4,628,717 discloses a combination lock having a tumbler wheel assembly shield for preventing an unauthorized lock manipulation. The shield covers the tumbler assembly and is sufficiently rigid to resist the forces of the end of a piece of bent wire, or similar tool, inserted from the front of the lock through the hole in the dial shaft thereby preventing the lock from being picked.

U.S. Pat. No. 3,741,597 discloses a mortise lock having a spindle hole with a protective guard disc of hardened metal which is mounted so that it is freely rotatable.

U.S. Pat. No. 3,204,438 discloses a lock for a parking meter having a metal disc rotatably mounted in a cylindrical space. The metal disc has central slot through which a key can pass to enter the lock. A drill attack on the lock will cause the metal disc to rotate when the tip of the drill reaches the central slot. The lock also has a hardened steel bushing sufficiently hard and axially outwardly in front of the metal disc to preclude tapping.

U.S. Pat. Nos. 2,947,160, 2,690,144, 1,550,953, 1,448,525 and 1,384,509 disclose auxiliary locking devices for rebolting a door to a safe body upon an unauthorized attempt to break into the safe.

U.S. Pat. No. 218,704 discloses an improved burglar-proof spindle for safes having a hardened steel bar within the spindle for breaking a drill off upon a drill attack on the spindle.

U.S. Pat. No. 119,258 discloses a lock-spindle for safes into two or more sections and interposing between them a piece or mass of hard and impenetrable material that a drill will not scathe.

Another interesting feature is that the circumference of the disc has a groove for holding a wire with a weighted plunger attached to a distal end of the wire. If the wire is broken during a drill attack the weighted plunger will fall into a notch in a second bolt latching mechanism that prevents the door from being unlatched.

BRIEF SUMMARY OF THE INVENTION

The following terms used in this application are meant to have the following meanings.

The term "inwardly" shall mean in the direction generally toward the center of the safe cavity unless otherwise specified.

The term "outwardly" shall mean in the direction generally from the center of the safe cavity and through the entry door, unless otherwise specified.

By the term "lock", as used herein, is meant a key lock, combination lock, or an electronic lock, or any other type of lock accessible by key, key card, dialing a combination, or electronic key pad for entry to a memory component of a computer or other device.

By the term "hardplate", as used herein, is meant a hardened steel plate which presents a significant resistance to drilling that is much greater than un-treated or un-hardened steel.

By the term "active hardplate", as used herein, is meant a hardplate which is displaceable spatially within a restricted space and/or in a confined manner in the safe.

Safes and other secured containments having various types of locks, and doors latching systems are made more secure by a moveable and active hardplate of this invention and an independent lockout system that prevents the unlatching of the door latching system when the active hardplate is moved by an attempted unauthorized entry.

The force necessary to penetrate a hardened steel plate or hardplate by a drill attack requires that a much greater force be applied to the drill bit to cause penetration into the hardplate. Ordinary drill bits will not penetrate hardplate but will be dulled or broken. The material of the hardplate makes it very difficult or impossible to drill through. Any type of commercially available hardplate can be used. A preferred hardplate material comprises hard particles such as sintered tungsten carbide granules brazed onto a steel plate with a nickel silver brazing material.

It is believed that a lock having a protective hardplate that will resist a drill attack until a predetermined force is exerted on the hardplate that is effective for forcing the hardplate to be spatially displaced, and which displacement prevents the unlatching of the latch bolt or bolts, will greatly improve the security of safes by substantially prolonging the time required to break into the safe.

DETAILED DESCRIPTION OF THE INVENTION

Figure 1:
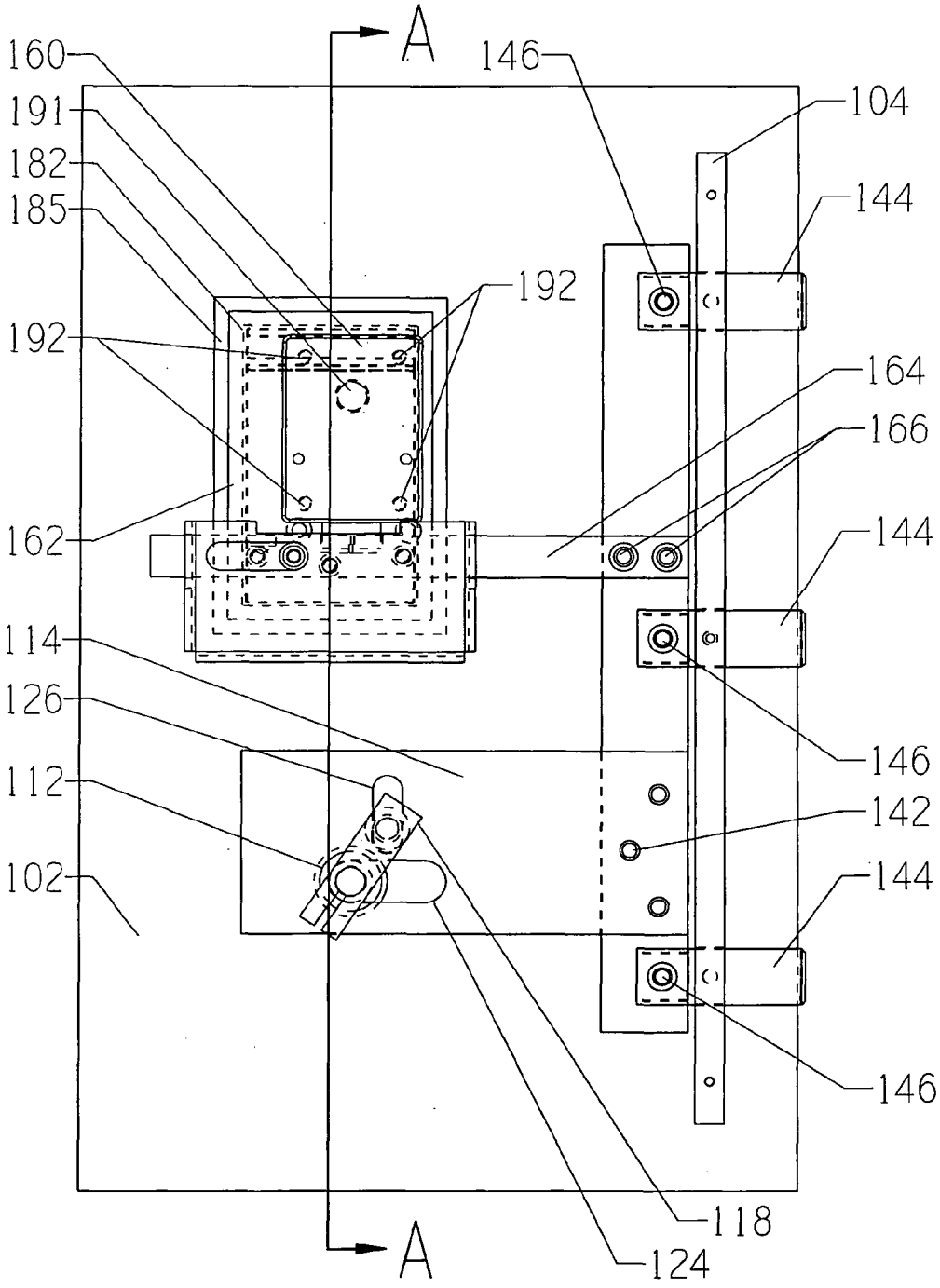
FIG. 1 is a view of the back side of a safe door showing an embodiment of an active hardplate of this invention.

This invention can be used on most locks if not all locks, including but not limited to locking mechanisms such as keyed tumblers, combination locks, fingerprint or other biometric recognized locks, and electronic activated locks, including card activated locks.

Combination locks usually have a dial for inputting a secret combination. Electronic locks usually have a key pad for inputting a secret combination and other secret information such as user identity, and authorization codes. This invention is especially useful for electronic locks for small stores, including fast food and drink stores open 24 hours a day, and automated teller machines or ATM's. Aperture 191 indicates a location where a key cylinder, or dialer, or electrical connections can be installed for various types of lock mechanisms; see FIGS. 1 and 5. Aperture 191 is also referred to as the lock aperture.

FIGS. 1-5 illustrate an embodiment 100 of a safe locking system having multiple latch bolts 144 driven by a moveable carriage bar 140, and having a lock 160 protected by an active hardplate 182. FIGS. 1-5 also show the locking system in a locked state.

FIG. 1 illustrates the inside or rear facing surface of a safe door 102 featuring the locking system with an active hardplate 182 of this invention.

Figure 2:
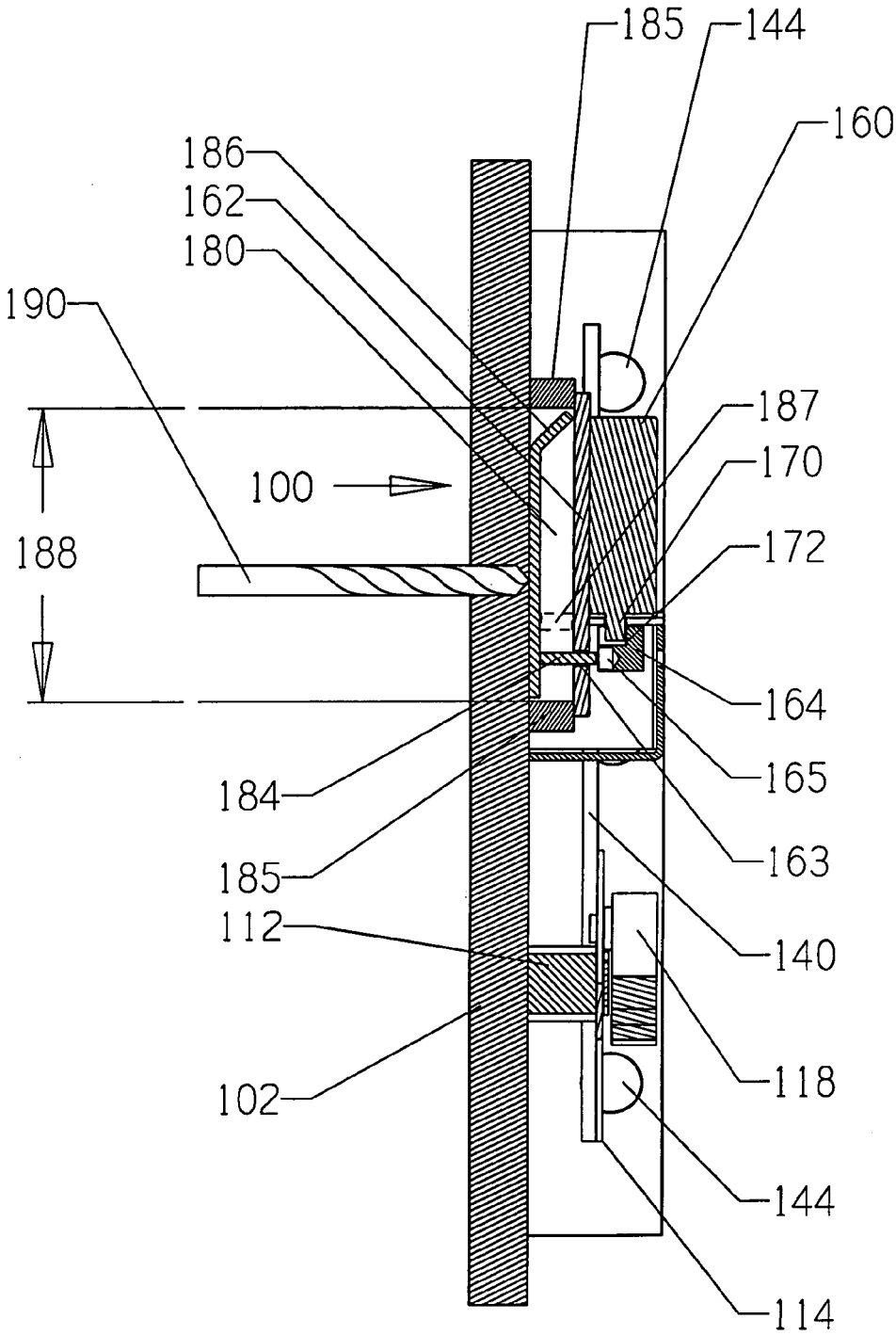
FIG. 2 is a cross sectional views through line A-A of FIG. 1 with the active hardplate under a drill attack.

FIG. 2 is a cross-sectional view through line A-A of FIG. 1 with the lock 160 under a drill attack and showing the tip of drill bit 190 penetrating a small portion 188 of the safe door 102 and positioned to attack active hardplate 182 next.

Figure 3:
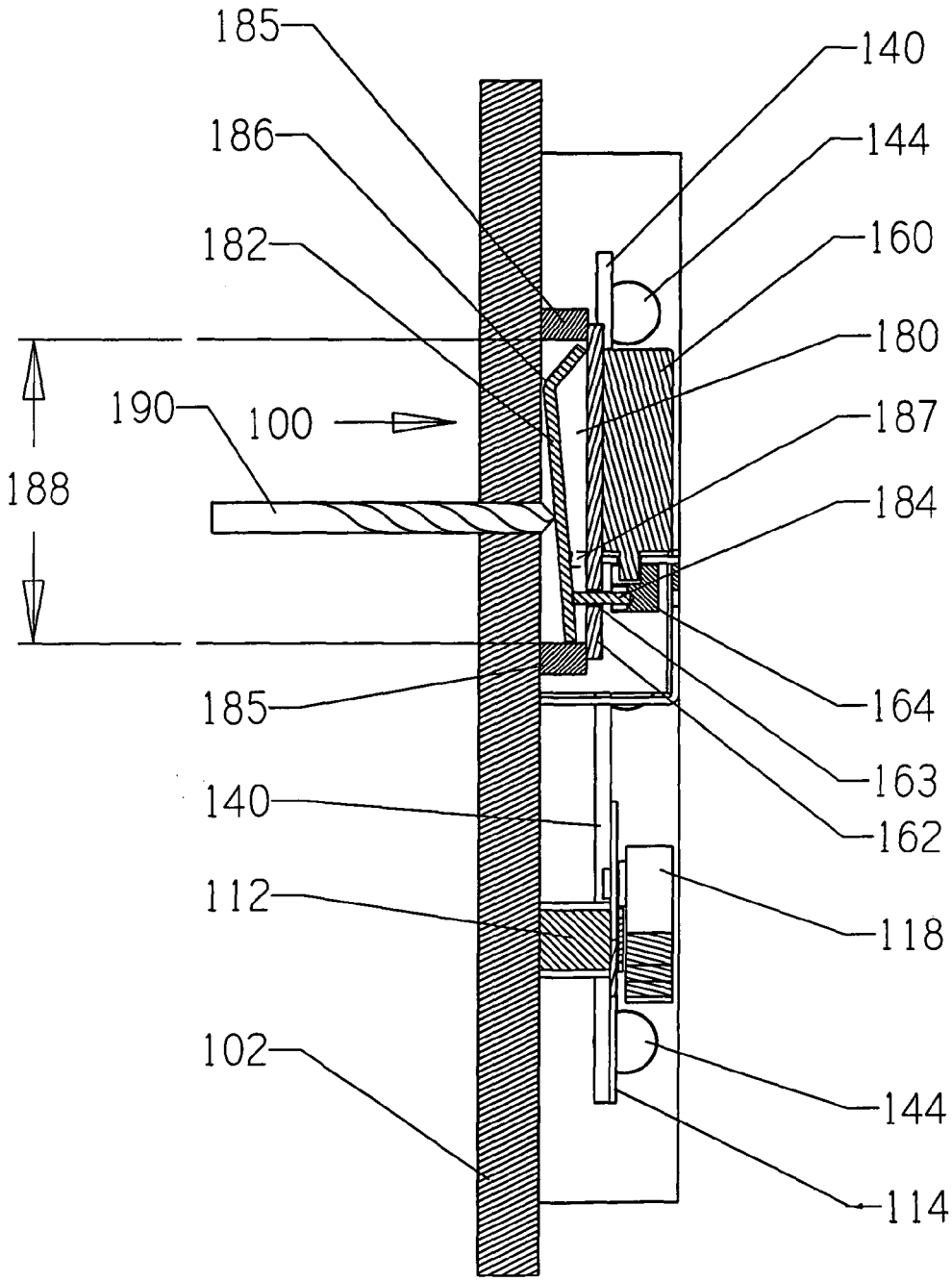
FIG. 3 is a cross sectional view through line A-A of FIG. 1 with the active hardplate under further drill attack in which the active hardplate has been displaced.

FIG. 3 is a corresponding view of FIG. 1 but with the drill bit 190 now having completely penetrated the small portion 188 of the safe door 102, however, hardplate 182 has not yet been penetrated. Nonetheless, hardplate 182 has now been activated by driving it inwardly towards a lock mount plate 162 and lock 160.

Figure 4:
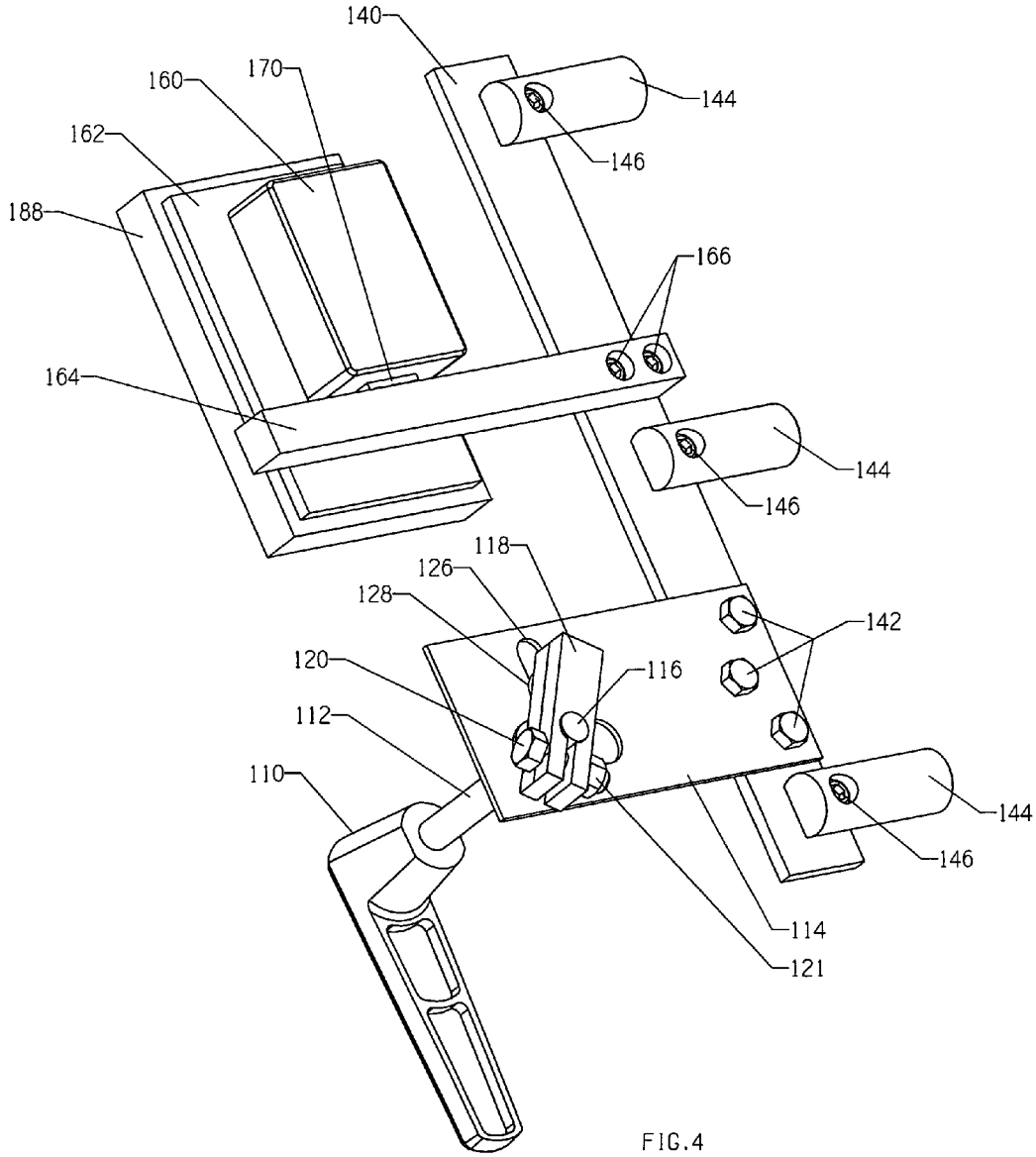
FIG. 4 is an orthogonal view from the lower left side of the back of the safe door showing the moveable latch system of FIG. 1.
Figure 5:
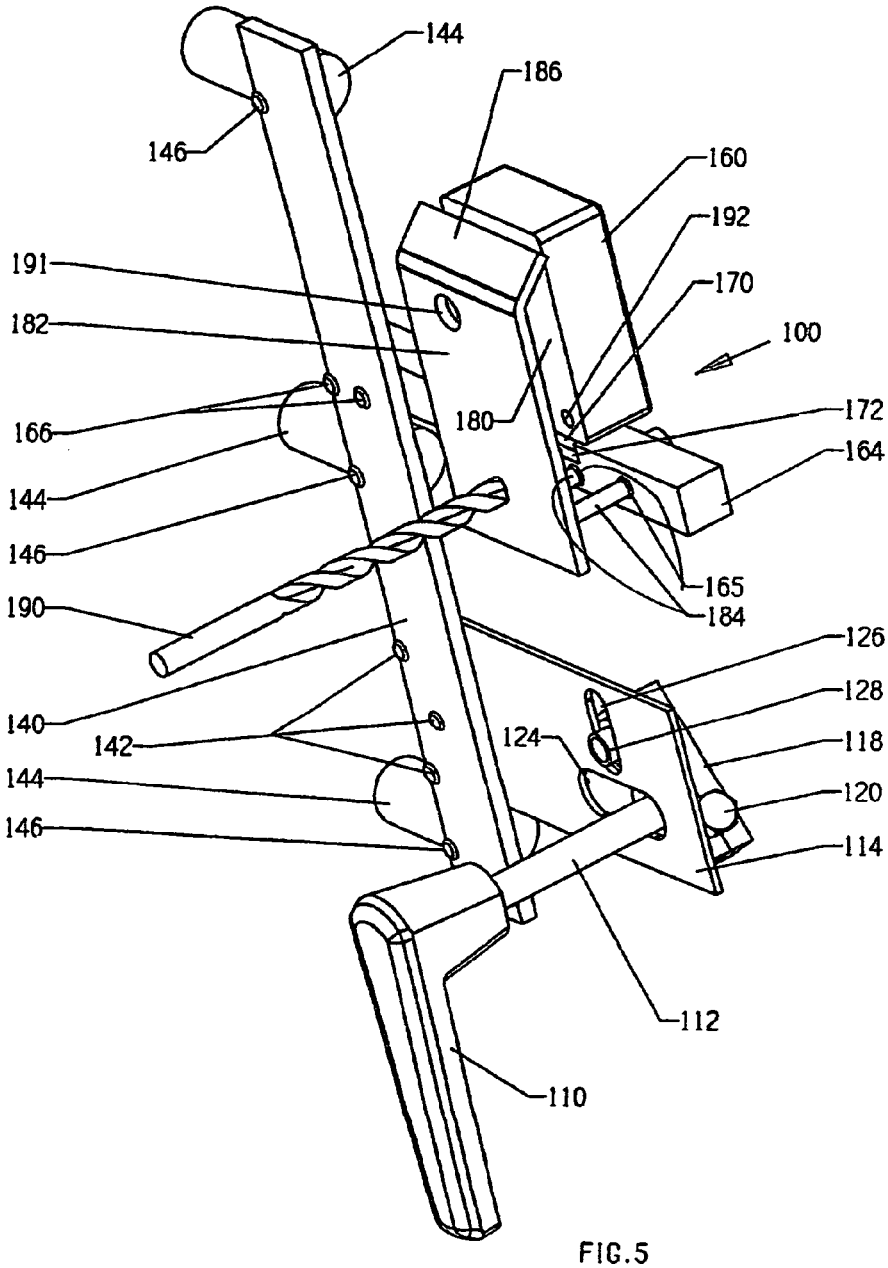
FIG. 5 is an orthogonal view from the lower right side of the front side of the moveable latch system of FIG. 4 showing the active hardplate under a drill attack.

The relatively small portion 188 of safe door 102 in front of the active hardplate 182 is seen best in FIGS. 2, 3 and 4. It is seen that the small portion 188 of the safe door is immediately in front of the active hardplate 182, which in turn is immediately in front of lock mount plate 162, which in turn is immediately in front of lock 160. Small portion 188 of the safe door 102 has been omitted in FIG. 5 to more clearly illustrate the other components of the safe locking system. The entire safe door is not shown in either FIG. 4 or FIG. 5 to more clearly illustrate the other components of the safe. FIGS. 4 and 5 illustrate the safe in a latched and locked state.

In particular FIGS. 4 and 5 illustrate a safe locking system comprising a handle 110 for opening and closing the safe door, and a shaft 112 that rotatably extends through another portion of the safe door, which is not shown in FIGS. 4 and 5 to better illustrate other components of this embodiment of the safe locking system. Shaft 112 is also shown in FIGS. 1, 2 and 3 but with the handle omitted. After shaft 112 passes through the safe door it slideably extends through a driver plate 114 located inside the safe and spaced away from the inside surface of the safe door. A distal end 116 of shaft 112 is fixed and secured to a driver 118 by a fastener or bolt 120 and nut 121. Shaft 112 contains opposite flat areas near and immediately before distal end 116 to insure that driver 118 rotates with handle 110.

Driver plate 114 further comprises cooperative cam slots 124 and 126. Slots 124 and 126 are spaced apart and are oriented approximately 90° relative to each other. Other effective orientation of the moving components for closing and latching the safe door can be used if desired.

Rotation of the door handle 110 causes shaft 112 to slideably move in cam slot 124, which causes a cam 128 to slideably move in cam slot 126, which cause latch bolts 144 to enter their associated respective locking bolt recesses in the body or frame 104 of the safe, not shown in FIGS. 4 and 5, thereby enabling the safe door to be in a closed and latched state as shown in FIGS. 1, 2, 3, 4 and 5. An opened state of the safe door is not shown in FIGS. 1, 2, 3, 4 and 5. Once the safe door is in its closed state, the safe can be locked, which is described more fully below.

Driver plate 114 is fixed to the moveable carriage bar 140 by bolts 142, which are secured in threaded holes in moveable carriage bar 140. A plurality of latch bolts 144 are fixed to carriage bar 140 by bolts 146 at a plurality of spaced apart locations. Bolts 146 also are secured in threaded holes in carriage bar 140. Latch bolts 144 extend into side frame 104 or body of the safe of FIG. 1 when safe door 102 is closed and latched, or when locked.

Lock 160 is attached to a lock mount plate 162 by bolts inserted through apertures 192 shown in FIGS. 1 and 5. Lock mount plate 162 is also spaced away from the safe door as seen in FIGS. 2 and 3.

A lock bar 164 is fixed to moveable carriage bar 140 by bolts 166, which are secured in threaded holes in carriage bar 140. Lock mount plate 162 is not shown in FIG. 5 to more clearly illustrate the other components of the moveable latch system.

Lock 160 has a lock bolt 170 or tongue that is extendable into a lock bolt recess 172 in lock bar 164. When the safe is in the locked state as shown in FIGS. 4 and 5, lock bolt 170 extends into lock bolt recess 172 and prevents the carriage bar 140 and the other moving parts of the door opening and closing linkages, i.e. the moveable latch system, from entering into the unlatched and unlocked state. Therefore, when lock bolt 170 is extended into lock bolt recess 172, the safe door, and safe, is locked.

Active hardplate 182 is confined to move in a restricted space 180 that is bounded in part by a hardplate enclosure 185, lock mount plate 162, and small portion 188 of safe door 102, see FIGS. 1, 2, 3 and 5. Active hardplate 182 can move in a direction roughly perpendicular to the plane of the lock mount plate 162 and lock 160 as seen in FIGS. 2, 3 and 5.

Press fitted into holding apertures 163 in a lock mount plate 162 are one or more lockout pins 184. Lockout pins 184 are effectively aligned with associated lockout recesses 165 in locking bar 164. Hardplate 182 is not attached to lockout pins 184, lock mount plate 162, locking bar 164 or carriage bar 140. Instead hardplate 182 is confined to move within the three dimensional restricted space 180 described above.

In this invention, active hardplate 182 has hardness effective for preventing, for example, a drill bit 190 from readily biting into the hardplate 182 thereby requiring a safecracker to exert more force on the drill bit 190 in an attempt to bite into hardplate 182. Such greater force will be effective at some point, e.g. preferably a predetermined force, for pushing or driving lockout pins 184 into their associated lockout recesses 165 in locking bar 164.

When lockout pins 184 are positioned in their respective lockout recesses 165 in locking bar 164 the lock bar cannot be moved into the unlatched and unlocked position even if lock bolt 170 is retracted into lock 160. Therefore, when lockout pins 184 are positioned in their respective lockout recesses 165 in locking bar 164, the unauthorized entry into the safe becomes much more time consuming thereby allowing the police more time to respond to an alarm system preferably associated with the safe or the building in which the safe is contained. Once lockout pins 184 are set in lockout recesses 165 a factory trained locksmith may be needed to open the safe and to subsequently repair the safe system.

For example, if the safe cracker were to attempt to disable the lock 160 by drilling into an area of the safe door directly in front of hardplate 182, i.e. the small portion 188 of the safe door 102, a drill bit 190 will soon reach hardplate 182. As more force is applied to the drill bit 190 in an attempt to cause the drill bit to bite into the hardplate 182, that greater force will, at some point, push lockout pins 184 that are abutted against hardplate 182 into their associated lockout recesses 165 in locking bar 164, as shown in FIG. 3, thereby preventing locking bar 164 from being moved thereafter into the unlatched safe door state or condition.

In a preferred embodiment, the lockout pins 184 that are press fitted into lockout recesses 165 are designed to require at least a force of about 60 lbs to be exerted by the drill bit 190 on the hardplate in order to push the lockout pins 184 into lockout recesses 165.

In an alternative embodiment, one or more springs 187 are installed between the active hardplate 182 and the lock mount plate 162 that require at least a force of about 60 lbs to be exerted by the drill bit 190 on hardplate in order to push hardplate 182 away from the safe door in order to push the lockout pins 184 within the holding apertures 163 into lockout recesses 165.

In either of the above embodiments, the predetermined force may be higher or lower depending on the desire of the owner of the safe. For example, the predetermined force can be about 30, about 60, about 90 or about 120 lbs.

Thus, the parameters for activating the independent lockout system can be tailored to the particular safe owner's requirements.

Turning back to the point as illustrated in FIG. 2 but before the point illustrated in FIG. 3, the safe door 102 can still be unlatched and unlocked in the usual authorized and legal manner. Hopefully, the time already spent trying to break into the safe will cause the burglary attempt to be abandoned and repairs to the safe door 102 will be minimized since the hardplate has not yet been activated.

However, once lockout pins 184 are inserted into lockout recesses 165 as illustrated in FIG. 3, the repairs to the safe become much more time consuming and may require a factory trained locksmith to open the safe and to subsequently repair the safe system. At this point too although there may be severe damage to the safe door, the safe door remains latched and cannot be opened yet without expending considerable more time breaking into the safe.

In another preferred embodiment, the active hardplate 182 has a bent flange portion 186 that acts as a hinge surface causing the activated hardplate to rotate slightly in a counterclockwise direction as shown in FIG. 3 within restricted space 180. The rotation of hardplate 182 is effective for causing the drill bit 190 to contact the hardplate at an angle that is not perpendicular to the surface of the hardplate, thereby rendering the hardplate even more difficult to be bitten into by the drill bit.

In one embodiment, a light or thin hardplate is used to reduce cost.

Thus in this invention, the active hardplate can be displaced upon a drill attack, which if so attacked is operable for causing an independent lockout system to move into a configuration that is effective for preventing the safe from being unlatched in the normal manner thereby providing even greater security for the contents of the safe.

The principles of this invention can also be incorporated in existing safes by retrofitting an active hardplate, lockout pins and lockout recesses in such safes.

While systems incorporating the active hardplates have been described and illustrated, those skilled in the art will appreciate that variations and modifications may be made without departing from the principles herein illustrated, described and claimed. The present invention, as defined by the appended claims, may be embodied in other specific forms without departing from the spirit or essential characteristics. The configurations described herein are to be considered in all respects as only illustrative, and not restrictive. All changes which come within the meaning and range of equivalency of the claims are to be embraced within their scope.

What is claimed is:

1. A safe comprising:

a safe body;

a safe door for entry into the safe body;

a moveable latch system effective for latching and unlatching the safe door to the safe body;

a safe lock attached to the safe door, wherein the safe lock has an extendable and retractable lock bolt for locking and unlocking, respectively, the safe door, wherein the safe lock has a lock aperture for receiving a key cylinder, or a dialer, or electrical connections or other locking and unlocking mechanisms through the lock aperture, and wherein the safe lock is spaced away from the safe door and wherein the lock aperture is directly inward of the safe door;

a lock bolt recess for receiving the lock bolt when extended;

an active hardplate located in, and free to move in, a restricted space located between the safe door and the safe lock effective for preventing a drill attack through the safe door into the safe lock without first drilling into the active hardplate and causing the active hardplate to be moved in the restrictive space and wherein the active hardplate is directly between the safe door and the safe lock; and independent lockout means effective for independently preventing the unlatching of the safe door upon movement of the active hardplate within the restrictive space.

2. The safe of claim 1, wherein the independent lockout means comprises a lockout pin responsive to movement of the active hardplate, and a lockout recess in the moveable latch system, and wherein movement of the active hardplate drives the lockout pin into the lockout recess and prevents the safe door from being unlatched.

3. The safe of claim 1, further comprising a lock mount plate having one side attached to the safe lock, and an opposite side that bounds in part the restrictive space.

4. The safe of claim 3, wherein the lock mount plate further comprises a holding aperture for holding a lockout pin and preventing the lockout pin from being driven into a lockout recess until a predetermined amount of force is exerted upon the active hardplate.

5. The safe of claim 1, wherein the active hardplate has a bent flange portion that acts as hinge means for presenting a slanted surface to a drill attack upon the safe lock.

6. The safe of claim 1, wherein the independent lockout means has a plurality of lockout pins and a plurality of lockout recesses such that each lockout pin has an associated lockout recess.

7. The safe of claim 1, wherein the independent lockout means comprises at least one lockout pin having a first part and a second part, and wherein the first part is within the restrictive space and is responsive to movement of the active hardplate, and the second part is not within the restrictive space and is in alignment with an associated lockout recess in the moveable latch system.

8. The safe of claim 1, wherein the independent lockout means has at least one holding aperture in the lock mount plate for releasably holding the at least one lockout pin; and wherein the moveable latch system has a lockout recess opposite the at least one lockout pin for receiving the at least one lockout pin when a predetermined amount of force is applied to the active hardplate.

9. The safe of claim 8, wherein the predetermined amount of force is about 60 lbs on the active hardplate.

10. A safe comprising:

a safe body;

a safe door for entry into the safe body;

a moveable latch system effective for latching and unlatching the safe door to the safe body;

a safe lock attached to the safe door, wherein the safe lock has an extendable and retractable lock bolt for locking and unlocking, respectively, the safe door;

a lock bolt recess for receiving the lock bolt when extended;

an active hardplate located in, and free to move in, a restricted space;

independent lockout means effective for independently preventing the unlatching of the safe door upon movement of the active hardplate;

a lock mount plate having one side attached to the safe lock, and an opposite side that bounds in part the restrictive space; and wherein the lock mount plate comprises a holding aperture for holding a lockout pin and preventing the lockout pin from being driven into a lockout recess until a predetermined amount of force is exerted upon the active hardplate.

11. A safe comprising:

a safe body;

a safe door for entry into the safe body;

a moveable latch system effective for latching and unlatching the safe door to the safe body;

a safe lock attached to the safe door, wherein the safe lock has an extendable and retractable lock bolt for locking and unlocking, respectively, the safe door;

a lock bolt recess for receiving the lock bolt when extended;

an active hardplate located in, and free to move in, a restricted space;

independent lockout means effective for independently preventing the unlatching of the safe door upon movement of the active hardplate; and wherein the active hardplate has a bent flange portion that acts as hinge means for presenting a slanted surface to a drill attack upon the safe lock.

12. A safe comprising:

a safe body;

a safe door for entry into the safe body;

a moveable latch system effective for latching and unlatching the safe door to the safe body;

a safe lock attached to the safe door, wherein the safe lock has an extendable and retractable lock bolt for locking and unlocking, respectively, the safe door;

a lock bolt recess for receiving the lock bolt when extended;

an active hardplate located in, and free to move in, a restricted space;

independent lockout means effective for independently preventing the unlatching of the safe door upon movement of the active hardplate; and means for moving a fresh and undamaged segment of the active hardplate in the path of the drill.

13. A safe comprising:

a safe body;

a safe door for entry into the safe body;

a moveable latch system effective for latching and unlatching the safe door to the safe body, the moveable latch system being attached to an inside surface of the safe door;

a safe lock attached to the safe door, the safe lock having an extendable and retractable lock bolt, wherein when the safe door is closed and the moveable latch system is latched the lock bolt can be extended into a lock bolt recess in the moveable latch system to lock the safe;

a lock bolt recess for receiving the lock bolt when extended;

an active hardplate located in a restricted space located between the safe door and the safe lock, wherein the restrictive space is aligned with the safe lock, wherein the active hardplate is not attached to the safe body, or to the safe door, or to the moveable latch system, and wherein the active hardplate is free to move in a predetermined manner within the restrictive space;

independent lockout means having a portion thereof that is within the restrictive space and another portion thereof that is not within the restricted space, the independent lockout means being effective for preventing the unlatching of the safe door upon movement of the active hardplate; and a spring located between the active hardplate and the lock mount plate, the spring being effective for providing a predetermined amount of resistance to movement of the active hardplate.

14. The safe of claim 1, wherein the independent lockout means is inward of the active hardplate.

* * * * *